United States Patent [19]

Lynch et al.

[11] Patent Number: 4,749,915

[45] Date of Patent: Jun. 7, 1988

[54] MICROWAVE POWERED ELECTRODELESS LIGHT SOURCE UTILIZING DE-COUPLED MODES

[75] Inventors: Donald Lynch, Gaithersburg; Mohammad Kamarehi, Rockville; Michael G. Ury, Bethesda; Charles H. Wood, Rockville, all of Md.

[73] Assignee: Fusion Systems Corporation, Rockville, Md.

[21] Appl. No.: 865,488

[22] Filed: May 21, 1986

Related U.S. Application Data

[63] Continuation-in-part of Ser. No. 677,137, Nov. 30, 1984, abandoned, which is a continuation-in-part of Ser. No. 381,482, May 24, 1982, Pat. No. 4,507,587.

[51] Int. Cl.[4] ..... H05B 41/16; H05B 41/24

[52] U.S. Cl. ..... 315/248; 315/39; 315/344; 313/493

[58] Field of Search ..... 315/39, 111.21, 344, 315/39.3, 248, 151, 176, 156; 313/439

[56] References Cited

U.S. PATENT DOCUMENTS

| | | | |
|---|---|---|---|
| 4,042,850 | 8/1977 | Urz et al. | 315/39 |
| 4,144,436 | 3/1979 | Hauck | 219/10.55 F |
| 4,359,668 | 11/1982 | Urz | 315/39 |
| 4,498,029 | 2/1985 | Yoshizawa et al. | 315/39 |
| 4,504,768 | 3/1985 | Urz et al. | 315/39 |
| 4,507,587 | 3/1985 | Wood et al. | 315/39 |
| 4,633,140 | 12/1986 | Lynch et al. | 313/493 |

*Primary Examiner*—David K. Moore
*Assistant Examiner*—Michael Razavi
*Attorney, Agent, or Firm*—Pollock, Vande Sande & Priddy

[57] ABSTRACT

A microwave powered electrodeless light source in which a relatively high power level is coupled to the bulb. This is accomplished by arranging for a plurality of energy modes which are substantially de-coupled from each other to be present in the microwave cavity.

1 Claim, 3 Drawing Sheets

FIG. 3
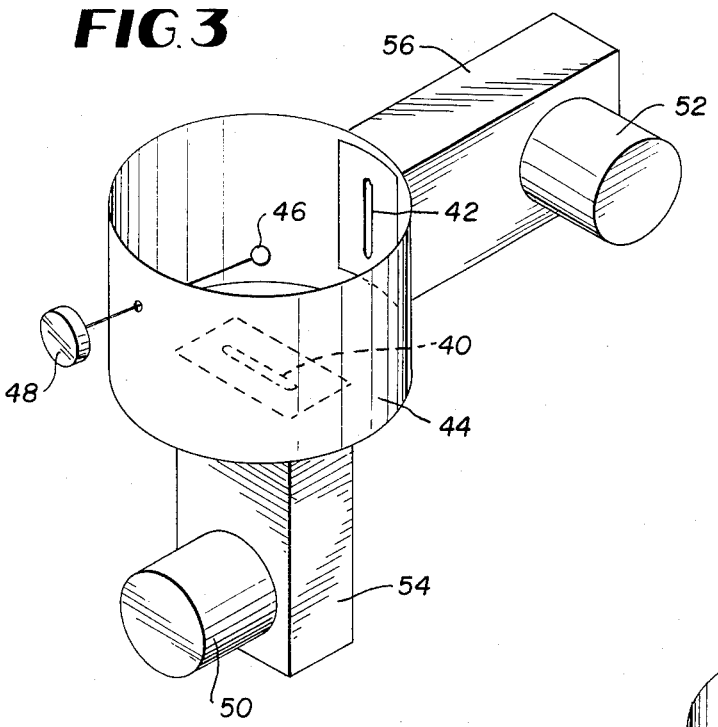
FIG. 4
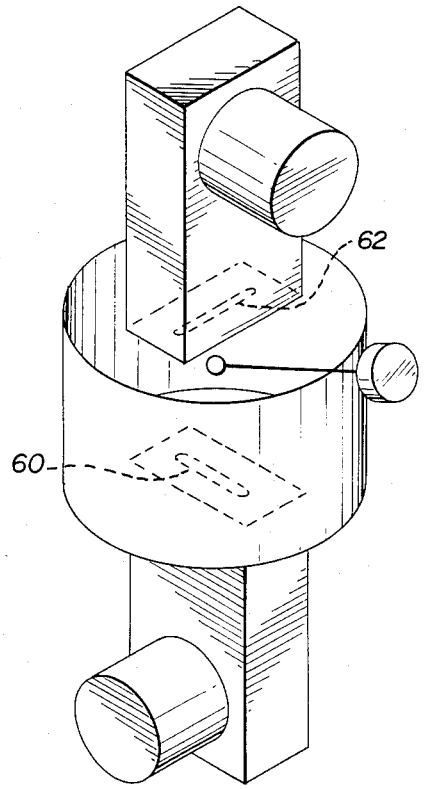
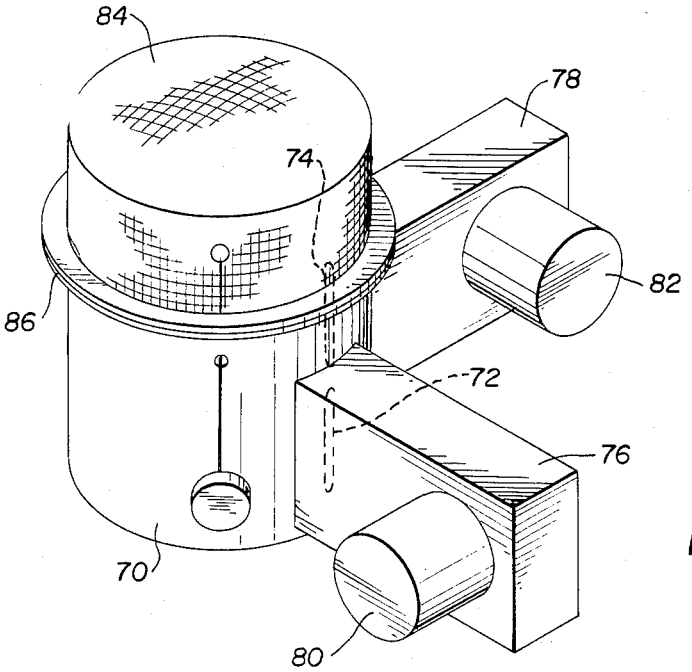
FIG. 5

FIG. 6
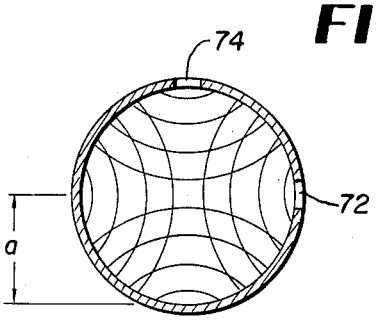
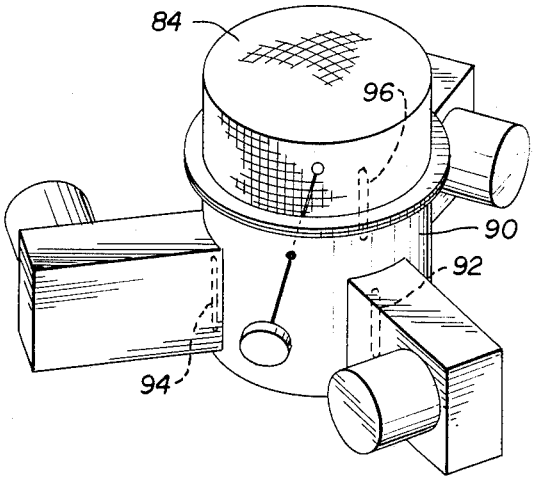
FIG. 7
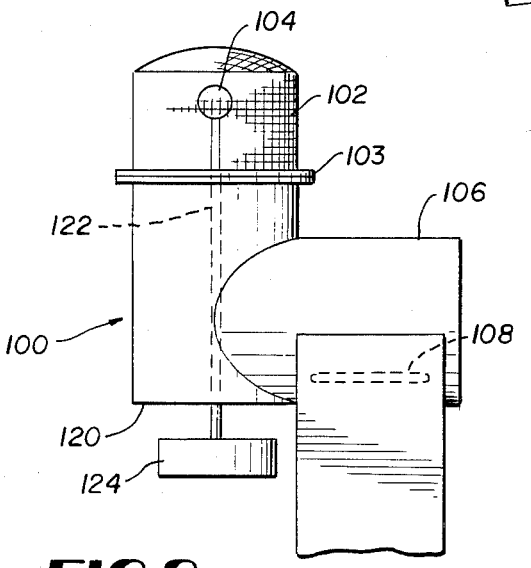
FIG. 8
FIG. 9
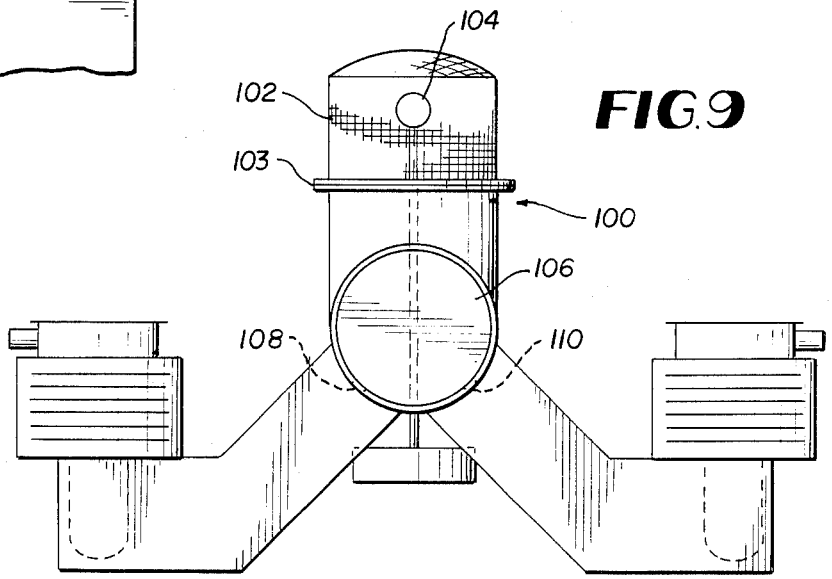

MICROWAVE POWERED ELECTRODELESS LIGHT SOURCE UTILIZING DE-COUPLED MODES

This application is a continuation in part of application Ser. No. 677,137, filed Nov. 30, 1984, now abandoned which in turn is a continuation in part of application Ser. No. 381,482 filed May 24, 1982, now U.S. Pat. No. 4,507,587.

The present invention is directed to an improved microwave powered electrodeless light source.

In recent years electrodeless light sources have become well known, and have found use in applications such as semiconductor device fabrication and the curing of photopolymerizable coatings and inks. Further, such sources may be useful for visible lighting applications.

In general, electrodeless light sources include a microwave cavity or chamber in which there is disposed an envelope or bulb containing a plasma-forming medium. A magnetron is provided for generating microwave energy, which is coupled to the cavity through a slot for exciting a plasma in the bulb, which emits radiation upon being excited. This radiation exits from the cavity through a portion thereof which is opaque to microwave energy but transparent to the radiation emitted from the bulb.

For some applications it is desirable to couple large amounts of microwave power to the bulb. For example, in some applications a very bright source is required, wherein it is necessary to couple large amounts of microwave power to a small bulb, resulting in relatively high power densities in the bulb. While for some such applications it is possible to use a conventional microwave cavity which is fed by a single magnetron, as the microwave power is increased, there is a tendency for the prior art system to result in problems and disadvantages. For example, when the microwave power exceeds a certain point, the coupling slot may break down, resulting in arcing across the slot. Additionally, at a certain power level, the cost of the magnetron rises rapidly, and it may therefore be uneconomical to use a single, high power magnetron.

An additional problem which exists when coupling to a small load such as a bulb in a microwave cavity is that before the bulb successfully lights, the standing wave ratio in the cavity is quite high, resulting in substantial reflected power. To ensure that the bulb starts, coupling of as much power as possible to the bulb at system turn on is desired.

To solve the above-mentioned problems and disadvantages, it is proposed by the present invention to use two or more microwave power sources and to couple the energy generated thereby to the microwave cavity in such manner that there is substantially no coupling in the cavity between the modes which are generated by the respective power sources. Since a number of magnetrons are used, no single magnetron needs to be of very high power, and the total cost for magnetrons is less than if a single, high power magnetron were used. Additionally, potential problems with arcing are obviated, the magnetron lifetime may be increased, and the bulb successfully starts.

In accordance with the invention, the configuration is arranged so that the energy modes in the cavity are substantially de-coupled from each other, thereby resulting in maximum power transfer from the magnetrons to the bulb. This is accomplished by arranging the electric fields in the cavity to be orthogonal to each other. It was found that if such de-coupling is not effected, the modes generated by the respective magnetrons interfere with each other, resulting in decreased power coupling to the bulb, de-tuning of the magnetrons, and difficult bulb starting.

Additionally, as will be described in greater detail below, the cavity may be folded to result in an arrangement which saves space and shortens the long dimension of the cavity.

It is therefore an object of the invention to provide a microwave powered electrodeless light source which couples high microwave power levels to the bulb in an effective manner.

It is a further object of the invention to provide such a light source which couples high power levels to the bulb in a cost-effective manner.

It is still a further object of the invention to couple microwave power to a bulb in such manner to result in effective starting.

It is still a further object of the invention to provide a microwave cavity arrangement which makes better use of available space.

The invention will be better understood by referring to the accompanying drawings in which.

FIGS. 3, 4, 5, and 7 are illustrations of embodiments of the invention utilizing a cylindrical cavity.

FIG. 6 is a diagram of the electric fields in the embodiment of FIG. 5.

FIGS. 8 and 9 are illustrations of an embodiment utilizing a folded cylindrical cavity.

Figure 1:
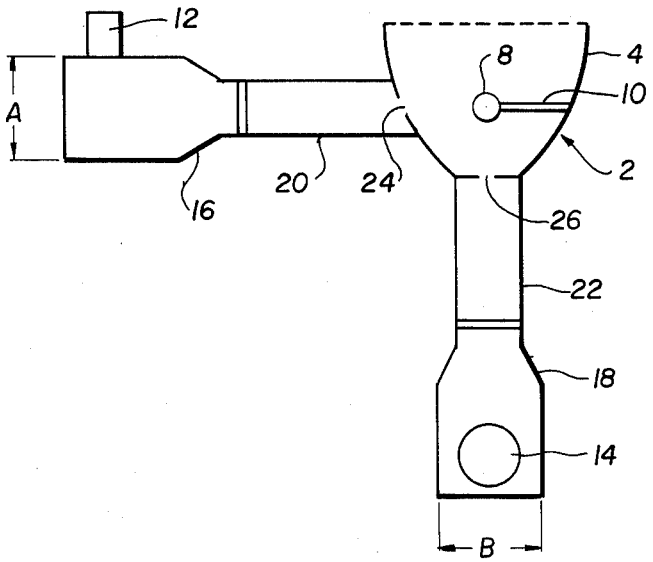
FIG. 1 is a cross-sectional view of an embodiment of the invention.

Referring to FIG. 1, an approximate cross-section of microwave powered electrodeless light source 2 is shown, which includes a microwave cavity, comprised of reflector 4 and mesh 6.

Bulb 8 is disposed in the cavity, and mesh 6 is effective to allow the ultraviolet or visible radiation which is emitted by bulb 8 to exit while retaining the microwave energy in the cavity. Bulb 8 is mounted by stem 10, which is rotated while cooling fluid streams are directed at the bulb to result in effective cooling as disclosed in U.S. Pat. No. 4,485,332.

Figure 2:
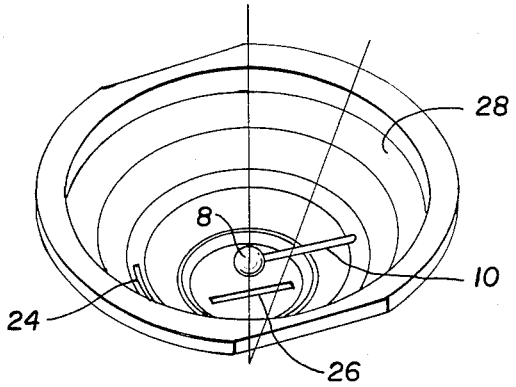
FIG. 2 illustrates the respective coupling slot orientations of the embodiment of FIG. 1.

Microwave energy is generated by magnetrons 12 and 14, and is coupled to the microwave cavity through launchers 16 and 18 and waveguides 20 and 22 respectively. Referring to FIG. 2, waveguide 20 feeds coupling slot 24 in the cavity, while waveguide 22 feeds coupling slot 26. FIG. 2 more clearly shows that the cavity 4 in certain embodiments may be comprised of a plurality of segments 28, each of which is relatively flattened as described in greater detail in U.S. application Ser. No. 707,159, now abandoned, to provide desired reflection of the emitted light which in other embodiments may be of different shape.

Coupling slots 24 and 26 are oriented so that they are substantially orthogonal to each other. This results in the energy modes which are coupled to the chamber from the respective waveguides being substantially de-coupled from each other, as the respective energy waves are cross-polarized.

As discussed above, this ensures that the respective energy modes do not interfere or cross-talk with each other and results in maximum power coupling to bulb 8.

Further, the use of two coupling slots obviates problems with arcing which could occur if a single slot were used and loaded with high power, and the use of two magnetrons is more economical than using a single magnetron of equivalent power output. Additionally, the arrangement provides for effective bulb starting.

Referring to FIG. 3, a further lamp arrangement is shown wherein orthogonally oriented coupling slots 40 and 42 are disposed in cylindrical cavity 44. Bulb 46 is located in the cavity and is shown as being rotated by motor 48. Magnetrons 50 and 52 feed waveguides 54 and 56 respectively, which in turn are coupled to slots 40 and 42.

FIG. 4 illustrates a further embodiment, similar to that depicted in FIG. 3, except that the orthogonally oriented slots 60 and 62, instead of being located in the cylindrical wall and bottom of the cavity are located in the top and bottom of the cavity.

The arrangements shown in FIGS. 3 and 4 are used in conjunction with a mesh which covers the open end of the cavity, and if desired, an exterior reflector.

In further embodiments, cavities may be fed by three slots, all of which are substantially mutually orthogonal.

In the embodiment shown in FIG. 5, a cylindrical cavity 70 has two parallel slots 72 and 74 disposed 90° from each other around the cylindrical wall. The slots 72 and 74 are fed by waveguides 76 and 78 respectively, to which magnetrons 80 and 82 are coupled.

The cavity is dimensioned so that the $TE_{11N}$ mode is set up in the cavity, and since the slots are displaced by 90°, the electric fields generated by the respective magnetrons in the cavity are orthogonal to each other.

This is illustrated in FIG. 6, which is a diagram showing the two electric fields in the cylindrical $TE_{11N}$ mode. Field 84 is generated by the energy feeding through slot 72 while field 86 is generated by the energy feeding through slot 74. It is noted that the $TE_{11N}$ mode is required for orthogonality of the fields, as for example the fields are in the radial direction in the cylindrical $TM_{011}$ mode and in the circumferential direction in the cylindrical $TE_{011}$ mode no matter where the slots are disposed in the cylindrical wall.

In the embodiment of FIG. 5, it is noted that the bulb is axially displaced from the slots, and in fact does not "see" the slots at all. This arrangement may promote eveness of bulb output as local distortions caused by slot proximity may be avoided.

Referring to the embodiment of FIG. 7, cylindrical cavity 90 is shown, having coupling slots 92, 94, and 96 disposed 120° from each other around the cylindrical wall. The cavity is in the cylindrical $TE_{11N}$ mode. Unlike the embodiment of FIG. 5, since the slots are not 90° apart, there is some cross-coupling between the electric fields. However, the provision of an additional power source provides significantly more energy, and it has been found that for some applications the trade-off between total power and field coupling obtained with the embodiment of FIG. 7 provides the best overall results.

Referring to FIG. 8 and 9, a lamp utilizing a folded cylindrical cavity 100 is shown. The term "folded cylindrical cavity" refers to a cavity which is comprised of two cylindrical portions which are at 90° to each other. Such a cavity has a "folded longitudinal axis" wherein the longitudinal axis portions corresponding to each cavity portion are at 90° to each other.

Thus, cavity 100 is comprised of portion 102 which houses bulb 104 and portion 106 in which coupling slots 108 and 110 are disposed. These slots are displaced 90° from each other, so that orthogonal electric fields in the $TE_{11N}$ mode are established.

The purpose of the folded cavity is to shorten the length of portion 102, which may make the lamp into a more convenient package and which may be physically necessary or desirable for certain applications for which the lamp is used.

The cavity in its entirety is a resonant structure, and is the first cavity of folded design known to the Applicants. It has been shown by experiments which have been performed that strong coupling of the fields to the bulb is attained with the folded design.

Also, in the design shown in FIGS. 7 and 8, bulb 104 is easily accessible for replacement through the bottom 120 of the cavity, as shaft 122 which communicates between the bulb and motor 124 extends through bottom 120.

It is noted that the folded cavity is applicable to designs in which a single coupling slot is present as well.

A working embodiment in accordance with FIGS. 1 and 2 has been utilized as the ultraviolet source in a photostabilization apparatus. In the actual embodiment, a segmented reflector as shown in FIG. 2 is utilized and the magnetrons are the Hitachi 2M131 each of which generates microwave energy at 2450 Mhz at approximately 1.5 kw. The chamber has a maximum vertical dimension in the figure of approximately 4 inches and a maximum horizontal dimension of approximately 8 inches. Additionally, the coupling slot dimensions are 2.5 inches by 0.3 inches.

In an exemplary embodiment of the cylindrical cavity structure having parallel coupling slots (FIG. 5) the diameter of the cavity is 2.90" and the length is 10.10", while the center of the bulb is positioned 1.15" from the screen and 6.75" from the center of the coupling slot.

While preferred and illustrative embodiments have been disclosed, it is to be understood that variations will occur to those skilled in the art, and the scope of the invention is to be limited only by the claims appended hereto and equivalents.

We claim:

1. A microwave powered electrodeless light source for emitting radiation, comprising a cylindrical microwave cavity having at least a portion which is substantially opaque to microwave energy but substantially transparent to said emitted radiation, said cylindrical cavity having a longitudinal axis, an envelope containing a plasma-forming medium disposed in said cavity and being supported therein by an elongated support, said cylindrical cavity having a plurality of coupling slots therein for coupling microwave energy to said cavity, said coupling slots being disposed so that their long dimensions are parallel to said longitudinal axis of said cylindrical cavity, a plurality of means for generting microwave energy, a waveguide means connecting each means for generating microwave energy with a said coupling slot, said elongated support for said plasma-forming medium containing envelope being disposed along or parallel to said longitudinal axis of said cylindrical cavity, and said cylindrical cavity comprises a folded cylindrical cavity having an envelope housing portion and a feed portion which are folded with respect to each other, said longitudinal axis comprising a folded axis, and wherein said plasma-forming medium containing envelope is disposed im said envelope housing portion and said coupling slots are disposed in said feed portion.

* * * * *